US011612998B1

(12) United States Patent
Byington

(10) Patent No.: US 11,612,998 B1
(45) Date of Patent: Mar. 28, 2023

(54) SLIDE TRAY FOR STORAGE OF MODULAR TOOLBOXES

(71) Applicant: Teran Byington, Bakersfield, CA (US)

(72) Inventor: Teran Byington, Bakersfield, CA (US)

( * ) Notice: Subject to any disclaimer, the term of this patent is extended or adjusted under 35 U.S.C. 154(b) by 0 days.

(21) Appl. No.: 17/464,564

(22) Filed: Sep. 1, 2021

Related U.S. Application Data

(60) Provisional application No. 63/073,272, filed on Sep. 1, 2020.

(51) Int. Cl.
*B25H 3/06* (2006.01)
*B25H 3/02* (2006.01)

(52) U.S. Cl.
CPC ..... *B25H 3/06* (2013.01); *B25H 3/021* (2013.01)

(58) Field of Classification Search
CPC . B25H 3/00; B25H 3/02; B25H 3/023; B25H 3/04; B25H 3/06; B25H 3/021; B25H 3/028; B65D 21/023; B65D 21/0209
USPC ..... 211/70.6
See application file for complete search history.

(56) References Cited

U.S. PATENT DOCUMENTS 3,780,905 A * 12/1973 Herolzer ..... B65D 21/046 206/511
4,113,329 A * 9/1978 Thurman ..... B65D 21/0213 206/509
4,531,645 A * 7/1985 Tisbo ..... B25H 3/00 211/163
5,016,948 A * 5/1991 Welch ..... B65H 35/002 D34/21
5,083,669 A * 1/1992 Wisehart ..... B25H 3/06 211/186
5,207,723 A * 5/1993 Newby, Sr. ..... B25H 3/00 312/249.11
5,244,265 A * 9/1993 Chiang ..... B25H 3/023 312/902
5,392,915 A * 2/1995 Kalin ..... B65D 25/06 206/508
5,664,856 A * 9/1997 Pacetti ..... A47B 88/975 312/348.3
6,637,592 B1 * 10/2003 Lai ..... B25H 3/023 312/902
6,955,271 B1 * 10/2005 Stallings ..... A47F 5/0043 211/144
7,464,819 B2 * 12/2008 Maietta ..... B65D 83/0463 206/536
8,714,355 B2 * 5/2014 Huang ..... B25H 3/028 312/111
8,763,820 B2 * 7/2014 Hanley ..... B60R 11/06 211/88.01
8,827,088 B1 * 9/2014 Krause ..... A61L 2/00 211/85.13
9,872,562 B2 * 1/2018 Brunner ..... A47B 96/06
10,524,587 B2 * 1/2020 Rosner ..... B25H 3/028
(Continued)

*Primary Examiner* — Patrick D Hawn
(74) *Attorney, Agent, or Firm* — James M. Duncan; Scanlon Duncan LLP

(57) ABSTRACT

A slide tray has a rectangular tray bottom having a left side, a right side, a front and a back. The rectangular tray bottom has a matrix of cutouts. This matrix of cutouts is configured such that slide tray may receive any one of several different modular toolboxes, regardless of the footprint of the modular toolbox. A plurality of slide trays may be attached between a left wall and a right wall, with each slide tray being attached to the left wall and right wall by telescoping slide rails.

8 Claims, 8 Drawing Sheets

(56) References Cited

U.S. PATENT DOCUMENTS

| | | | | |
|---|---|---|---|---|
| 10,583,962 | B2 * | 3/2020 | Brunner | A45C 13/02 |
| 11,034,370 | B2 * | 6/2021 | Cao | B62B 3/022 |
| 11,338,959 | B2 * | 5/2022 | Hoppe | B25H 3/023 |
| 11,426,859 | B2 * | 8/2022 | Squiers | B65D 21/0223 |
| 2004/0188294 | A1 * | 9/2004 | Chen | B25H 3/028 206/349 |
| 2007/0262038 | A1 * | 11/2007 | Harbison | A47J 47/16 211/162 |
| 2008/0121542 | A1 * | 5/2008 | Chang | B25H 3/028 211/49.1 |
| 2011/0259772 | A1 * | 10/2011 | Forsyth | B29C 65/562 206/320 |
| 2013/0108503 | A1 * | 5/2013 | Ramkhelawan | A61B 50/34 422/1 |
| 2014/0042113 | A1 * | 2/2014 | Cheng | A47B 55/02 211/126.15 |
| 2014/0291196 | A1 * | 10/2014 | Lindstrom | B65D 1/34 53/473 |
| 2014/0354001 | A1 * | 12/2014 | Hanley | B60P 3/007 296/24.44 |
| 2015/0274362 | A1 * | 10/2015 | Christopher | B65D 21/0219 206/506 |
| 2015/0336710 | A1 * | 11/2015 | Bar-Erez | B62B 1/142 206/508 |
| 2016/0144500 | A1 * | 5/2016 | Chen | B65D 21/023 206/349 |
| 2016/0257327 | A1 * | 9/2016 | Gayk, Jr. | B62B 1/12 |
| 2020/0189637 | A1 * | 6/2020 | Karlsson | B62B 5/0495 |
| 2022/0097926 | A1 * | 3/2022 | Whitmire | B25H 3/04 |

* cited by examiner

SLIDE TRAY FOR STORAGE OF MODULAR TOOLBOXES

RELATED APPLICATIONS

This application claims domestic priority to U.S. Provisional Application No. 63/073,272 filed on Sep. 1, 2020

BACKGROUND OF THE INVENTION

The present invention relates to the organization and storage of tools, hardware, and accessories.

Modular toolboxes, such as the MILWAUKEE PACK Out, the DeWALT TOUGH SYSTEM 2.0 and the RIGID PRO ORGANIZER provide a convenient way of transporting tools, hardware, and accessories to and from a shop to a job site utilizing modular toolboxes. These modular organizers, toolboxes and totes (collectively referred to as "modular toolboxes") typically have sectioned interiors provide for the storage and transport of a plurality of tool and hardware caddies contained within a single case. The cases within each system may be stacked in an interlocking configuration, which allows the stack of cases to be transported without risk of the stack falling.

While the above-described modular toolboxes function very well, the organizing, storing and securing of a number of modular toolboxes in a shop when the job has been complete can be a challenge. The modular toolboxes may contain valuable, expensive and/or irreplaceable items such as power tools, drill bits, blades, wrench and socket sets, or rare expensive mechanical components, such as automobile components. Organizing, storing, and securing of the modular toolboxes is a greater challenge when different models of toolboxes are stored together, because different models of the modular toolboxes typically do not interlock together, such that placing different models upon one another typically results in an unstable and wobbly stack. Securing the modular toolboxes can also be a challenge. While the modular toolboxes might be secured in a locked storage facility, such a solution is inconsistent with the simple elegance provided by the modular toolboxes themselves.

Another problem presented by the stacked modular toolboxes is that access to each box requires that the box have nothing on top of it. Therefore, if a user requires access to a modular toolbox which has other boxes stacked on top of it, the user must lift those boxes off the desired box to gain access to it. Because the weight of a box filled with hardware or tools may be significant, gaining access to a desired toolbox may involve lifting several heavy boxes.

SUMMARY OF THE INVENTION

Embodiments of the present invention provide a solution to the above-described problems which is as elegant as the modular toolboxes themselves. Embodiments of the present invention comprise one or more slide trays configured such that each slide tray has a rectangular tray bottom having a left side, a right side, a front and a back. Each tray bottom further has a unique matrix of cutouts. This matrix of cutouts is configured such that each slide tray may receive any one of several different modular toolboxes, regardless of the footprint of a particular modular toolbox.

The left side of a first rectangular tray bottom as described in the above paragraph is attached to a sliding member of a left-side telescoping slide rail, the left-side telescoping slide rail having a base member attached to an inside face of a left-side wall. Likewise, the right side of the first rectangular tray bottom is attached to a sliding member of a right-side telescoping slide rail, the right-side telescoping slide rail having a base member attached to an inside face of a right-side wall, wherein the inside face of the left-side wall is in opposite facing relation with the inside face of the right-side wall, and the left-side telescoping slide rail and the right-side telescoping side rail are in opposite facing and parallel configuration, thereby allowing the first rectangular tray bottom to be inserted and withdrawn from between the left-side wall and the right-side wall with the first rectangular tray bottom maintained in a level orientation.

Additional rectangular tray bottoms having the described unique matrix of cutouts may each be mounted on parallel and facing telescoping slide rails, with the additional rectangular tray bottoms being disposed in a stacked configuration. This configuration allows a plurality of stacked slide trays for any configuration of the available modular toolboxes offered by MILWAUKEE PACK Out, the DeWALT TOUGH SYSTEM 2.0 and the RIGID PRO ORGANIZER. This embodiment allows a user to withdraw any one of the slide trays from between the left-side and right-side walls and access the contents of a modular toolbox set upon the slide tray without the necessity of removing any of the upper modular toolboxes.

Units of the above-described embodiment may be connected is side-to-side configuration or stacked on upon another and mounted within a garage, truck or warehouse. In a stacked configuration, a lowermost unit of the above-described embodiment may comprise casters or wheels for ease of mobility. Alternatively, stacks of the above-described embodiment may be placed on a hand truck or dolly.

In another embodiment of the invention a plurality of slide trays may be configured to be attached within a lockable storage cabinet having a left-side wall and an opposite facing right-side wall, where the left-side wall has a left-side rear facing edge and a left-side front facing edge and the right-side wall has a right-side rear facing edge and a right-side front facing edge. A back wall having an inside facing surface is attached to the left-side rear facing edge and the right-side rear facing edge such that the left-side wall and the right-side wall are normal to the inside facing surface.

In another embodiment of the invention, a first plurality of telescoping slide rails is disposed in a first parallel and spaced apart placement along an inside face of the left-side wall. Likewise, a second plurality of telescoping slide rails is disposed in a second parallel and spaced apart placement along an inside face of the right-side wall, so configured such that each slide rail of the first plurality is in opposite and facing relation with a counter-part slide rail of the second plurality. A slide tray as described above is received within each pair of opposite facing telescoping side rails. In this embodiment, each slide tray may be retracted from the storage cabinet for easy placement, removal and access to a modular toolbox.

Another embodiment of the present invention has a single front panel assembly which is hingedly attached to either the left-side wall or the right-side wall, an a locking mechanism on the opposite wall A variation of this embodiment may have a left-side front panel hingedly attached to the left-side wall and a right-side front panel hingedly attached to the right side wall, with a locking mechanism which secures the left-side panel to the right-side panel when the panels are in a closed position.

Thus, embodiments of the present invention allow the secure storage of a mixture modular toolboxes from different model lines and manufacturers.

DETAILED DESCRIPTION OF THE EMBODIMENTS

Figure 1:
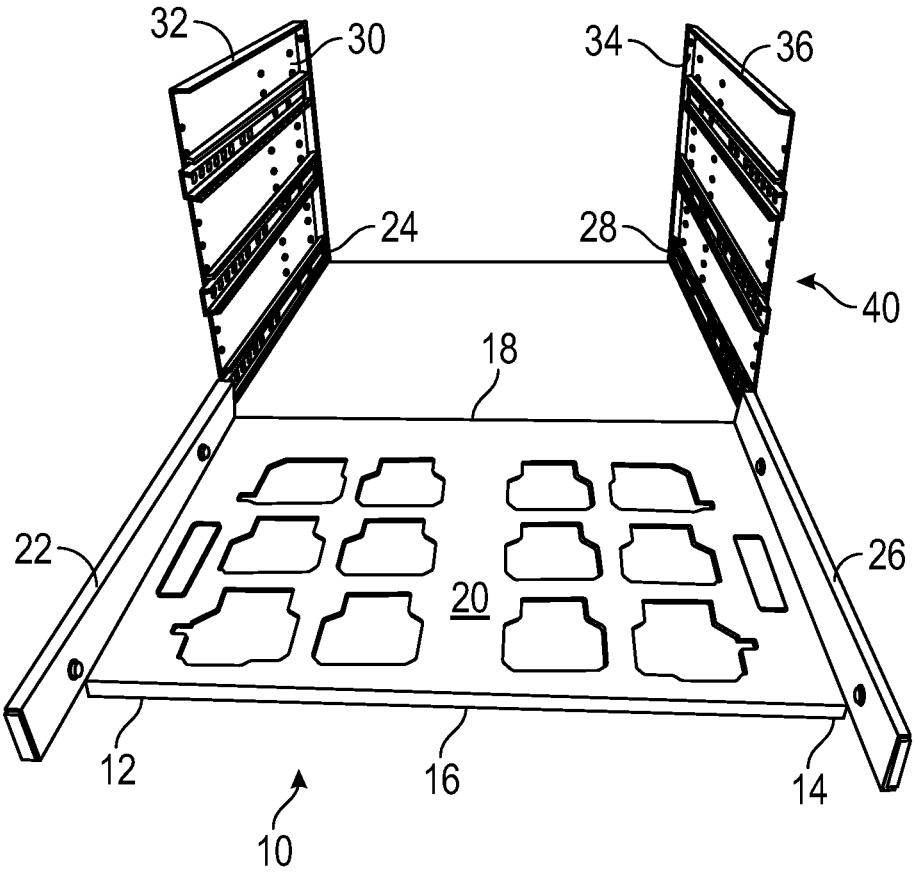
FIG. 1 shows a front perspective view of an embodiment of the present slide tray having telescoping side rails attached to opposing wall members.

Referring now to the Figures, FIG. 1 depicts an embodiment of the present slide tray 10 having a left side 12 Slide tray 10 has a left side 12, a right side 14, a front side 16, and a backside 18. Slide tray 10 also has a rectangular bottom 20. Rectangular bottom 20 has a matrix (or pattern) of cutouts which fully penetrate through rectangular bottom 20. Left side 12 may be attached to a slide member 22 of a left-side telescoping rail 24. Right side 14 may be attached to a slide member 26 of a right-side telescoping rail 28. Left-side telescoping rail 24 may be attached to an inside face 30 of left-side wall 32 and right-side telescoping rail 28 may be attached to an inside face 34 of a right-side wall 36, with the completed structure forming slide tray structure 40.

Figure 2:
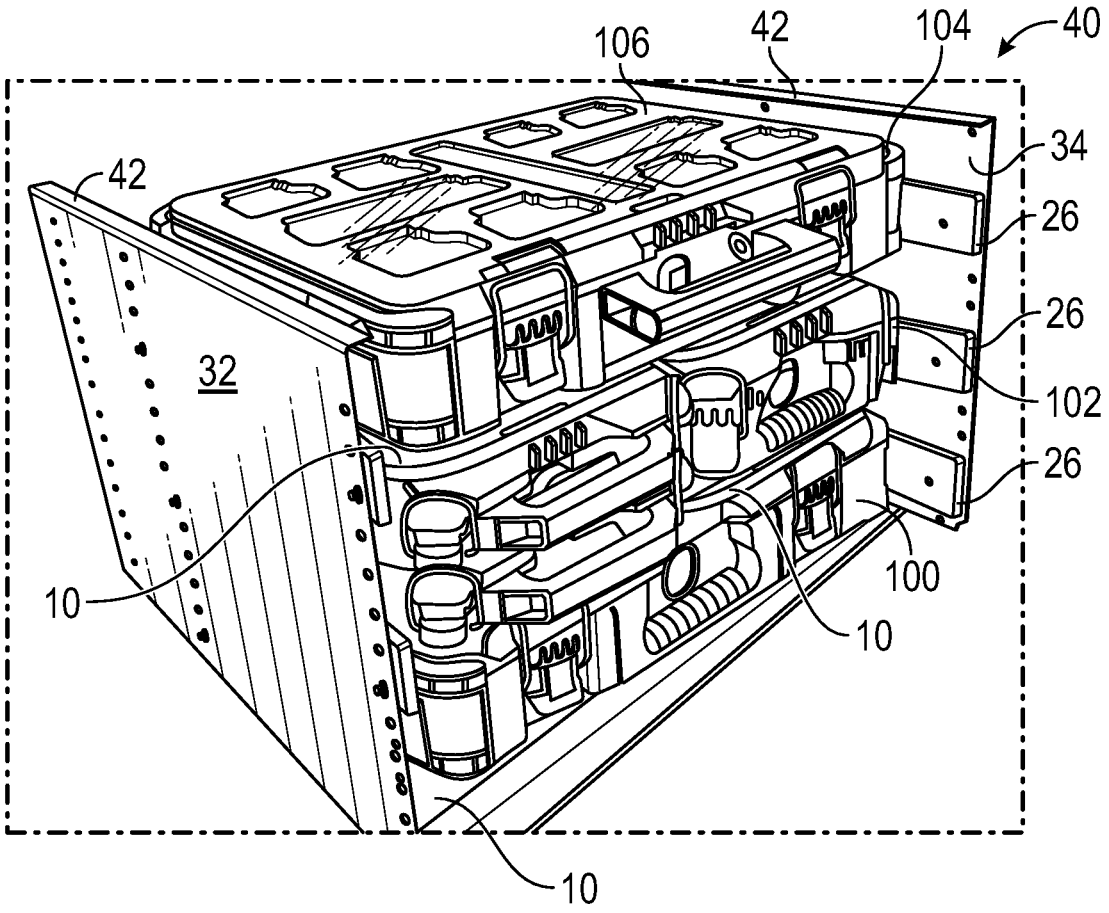
FIG. 2 shows a plurality of modular toolboxes disposed upon slide trays of the present invention.

FIG. 2 shows a slide tray structure 40 which has received modular toolboxes 100, 102, 104. It is to be appreciated that modular toolboxes of a particular manufacturer and model will have bases with downwardly facing male locking members which will be received into corresponding female apertures set within the top of an underlying modular toolbox of the same manufacturer and model, such as top 106 depicted in FIG. 2. This feature allows modular toolboxes of the same model and manufacturer to be configured in a secure stack. However, modular toolboxes of a different manufacturer cannot be securely stacked because of the different configuration or pattern of the male locking members and female apertures.

As depicted in the embodiment of the invention shown in FIG. 2, a slide tray structure 40 may have multiple slide trays 10 set at different levels within the structure. The slide tray structure 40 depicted in FIG. 2 has closely spaced slide trays 10 with each tray attached to left-side telescoping rail 24 and right-side telescoping rail 26. As indicated by FIG. 2, the left-side wall 32 and right-side wall 34 may comprise pre-set apertures for setting the levels of the different left-side telescoping rails 24 and right-side telescoping rails 26 to adjust the spacing between the different slide trays 10 and thus the spacing between the modular toolboxes 100, 102, 104. Slide tray structure 40 may also comprise flanges 42 and multiple apertures which are configured to facilitate the attachment of an additional structures to either side, or to stack multiple slide tray structures.

Figure 3:
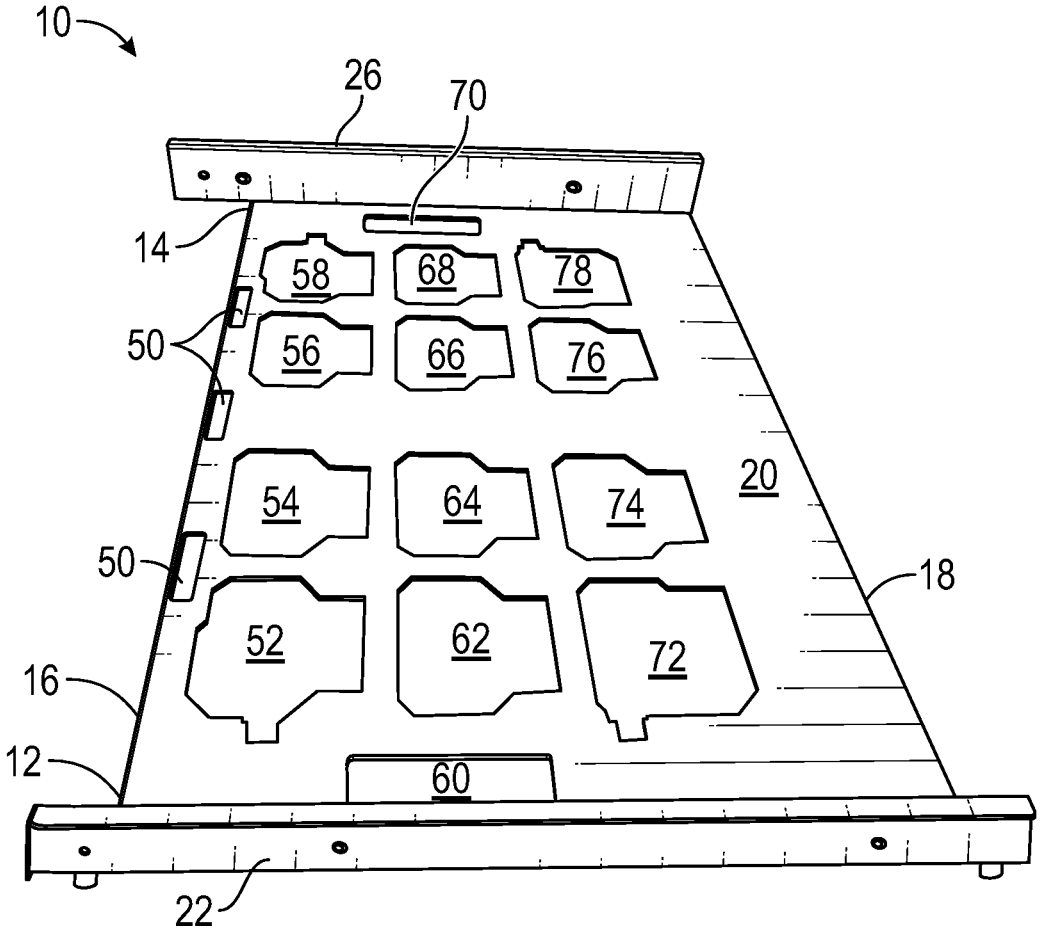
FIG. 3 shows a side perspective view of an embodiment of a slide tray of the present invention.

FIG. 3 shows an embodiment of a slide tray 10 of the present invention, showing the configuration of the matrix of cutouts for receiving the downwardly facing male locking members on the base of a modular toolbox 100, 102, 104. As shown in FIG. 3, the matrix may comprise a first row of three equivalent shaped and sized rectangular cutouts 50.

The matrix may further comprise a second row of four polygonal cutouts comprising, in order from the left side 12 to the right side 14, a second row left outside cutout 52 adjacent to the left side 12, a second row left inside cutout 54, a second row right inside cutout 56, and a second row right outside cutout 58 adjacent to the right side 14. The second row left outside cutout 52 and the second row right outside cutout 58 may be mirror images of each other and have equivalent sizes and shapes. The second row left inside cutout 54 and the second row right inside cutout 56 may be equivalent in size and shape.

The matrix may further comprise a third row of six polygonal cutouts comprising a third row left rectangular cutout 60, a third row left outside cutout 62, a third row left inside cutout 64, a third row right inside cutout 66, a third row right outside cutout 68 and a third row right rectangular cutout 70. The third row left rectangular cutout 60 and the third row right rectangular cutout 70 may be equivalent in size and shape, and the remaining four cutouts 62, 64, 66, 68 of the third row may also be equivalent in size and shape.

The matrix may further comprise a fourth row of four polygonal cutouts comprising a fourth row left outside cutout 72 adjacent to left side 12, a fourth row left inside cutout 74, a fourth row right inside cutout 76, and a fourth row right outside cutout 78 adjacent to the right side 14. The fourth row left outside cutout 72 and the fourth row right outside cutout 78 may be mirror images of each other and have equivalent sizes and shapes. The fourth row left inside cutout 74 and the fourth row right inside cutout 76 may be equivalent in size and shape.

Figure 4:
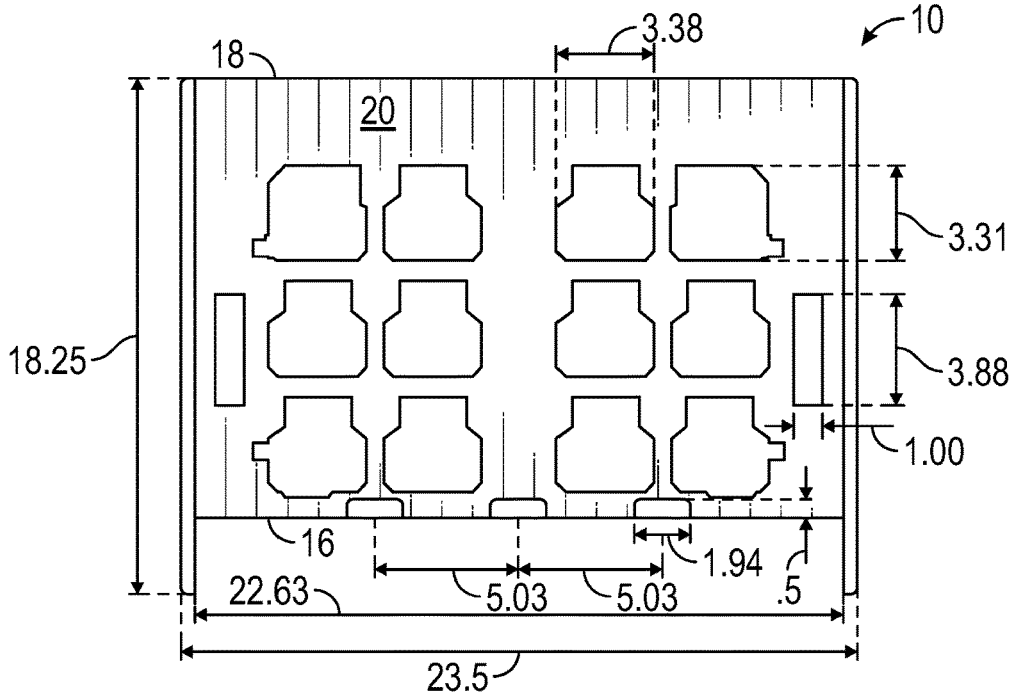
FIG. 4 shows a plane view of an embodiment of a slide tray of the present invention showing dimensions which allow embodiments of the present invention to receive multiple different models of modular toolboxes.
Figure 5:
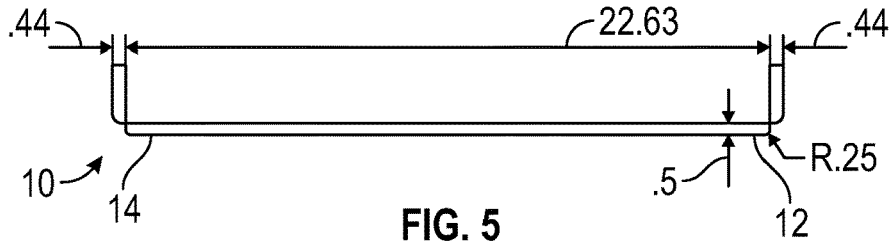
FIG. 5 shows a front view of an embodiment of the present invention showing dimensions which allow embodiments of the present invention to receive multiple different models of modular toolboxes.
Figure 6:
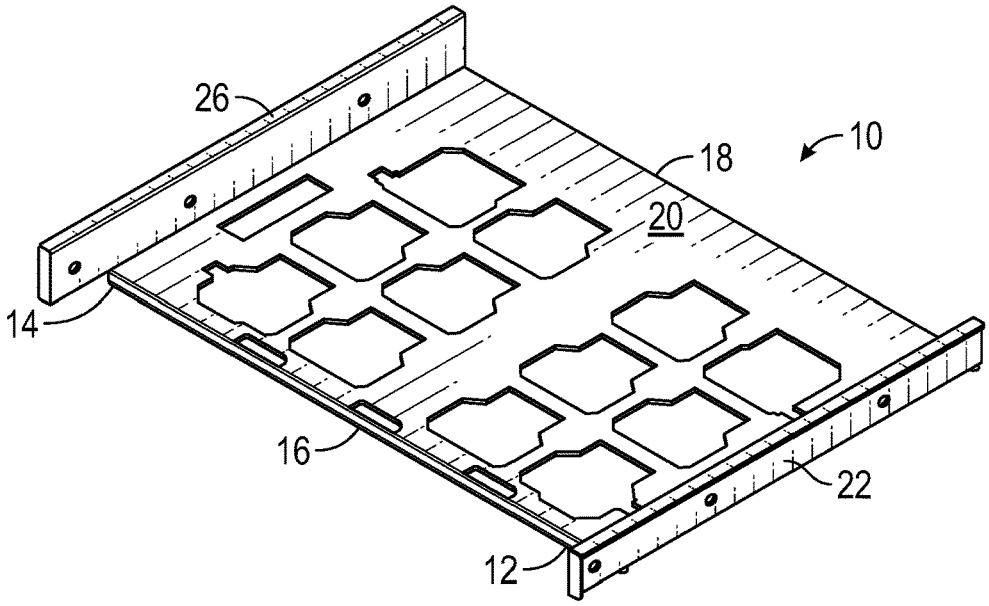
FIG. 6 shows a top perspective view of an embodiment of a slide tray of the present invention.

FIGS. 4-5 show different views of a slide tray 10, depicting dimensions of the slide tray and cutouts which have been found to accommodate the patterns of the downwardly facing male locking members of a variety of different modular toolboxes, including the MILWAUKEE PACK Out, the DeWALT TOUGH SYSTEM 2.0 and the RIGID PRO ORGANIZER.

Figure 7:
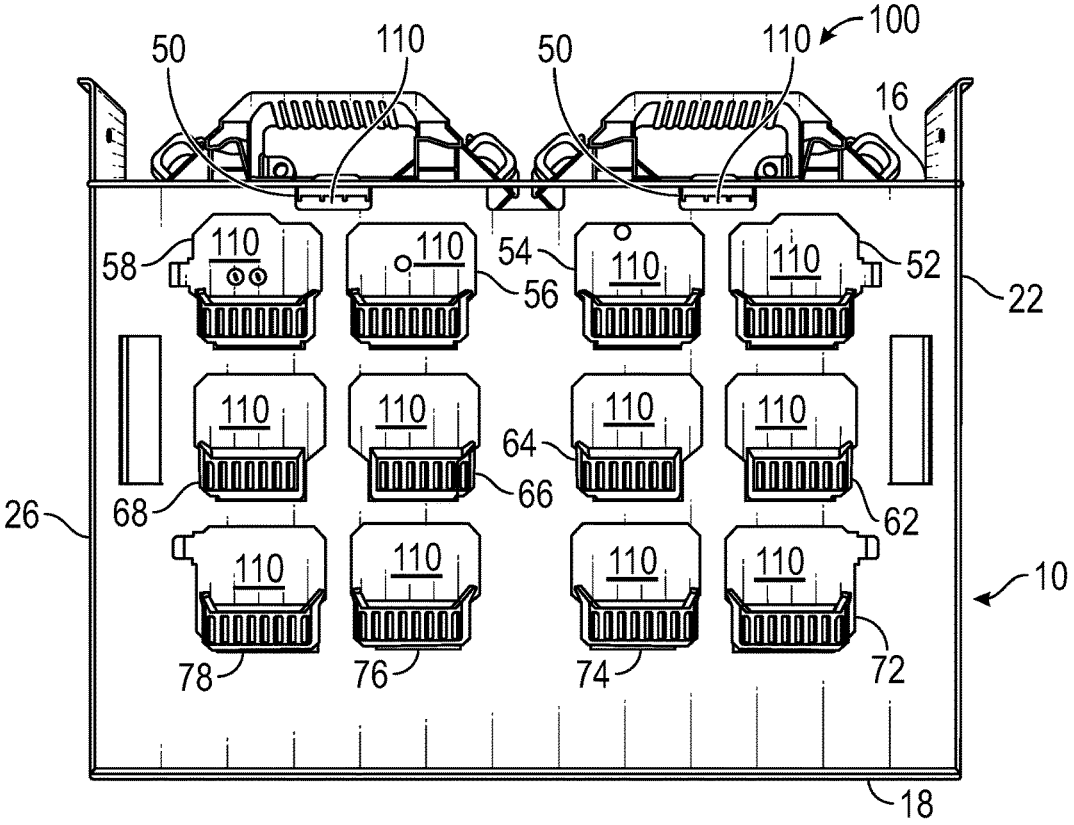
FIG. 7 shows a bottom view of an embodiment of a slide tray showing how the cutouts of the slide tray receive the footprint of a particular modular toolbox.

FIG. 7 shows a bottom view of a slide tray 10 upon which modular toolbox 100 has been placed, showing how the male downwardly facing locking members 110 on the base of the modular toolbox are respectively received within cutouts 50, 52, 54, 56, 58, 62, 64, 66, 68, 72, 74, 76, 78.

Figure 8:
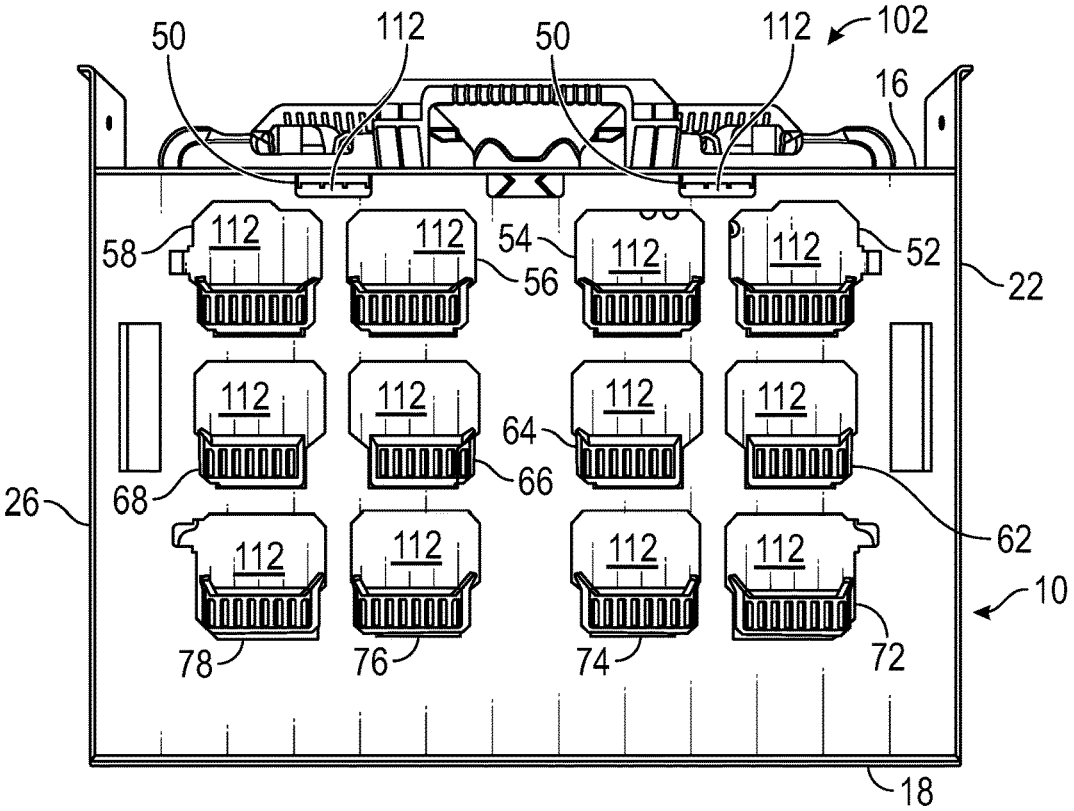
FIG. 8 shows a bottom view of an embodiment of a slide tray having the same cutouts as the slide tray of FIG. 7 but showing how the slide tray receives a modular toolbox having a different footprint from the modular toolbox of FIG. 7.

FIG. 8 shows a bottom view of a slide tray 10 upon which a modular toolbox 102 has been placed, showing how the male downwardly facing locking members 112 on the base of the modular toolbox are respectively received within cutouts 50, 52, 54, 56, 58, 62, 64, 66, 68, 72, 74, 76, 78.

Figure 9:
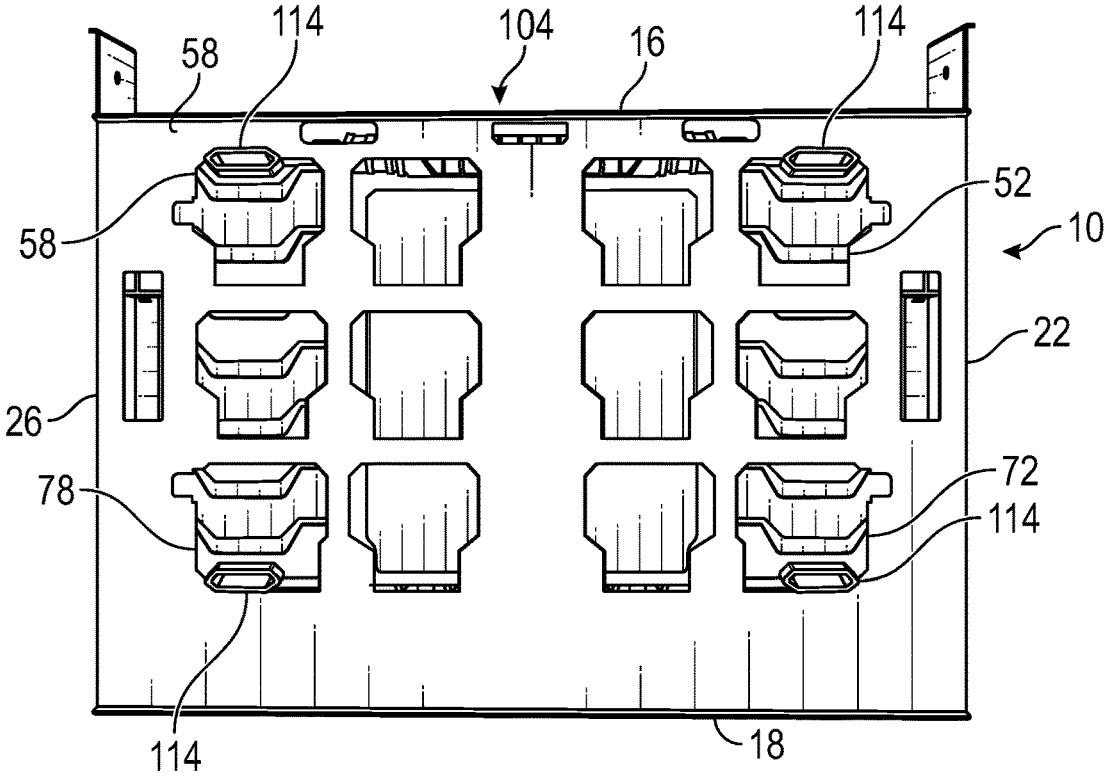
FIG. 9 shows a bottom view of an embodiment of a slide tray having the same cutouts as the slide trays of FIGS. 7-8 but showing how the slide tray receives a modular toolbox having a different footprint from the modular toolboxes of FIGS. 7-8.

FIG. 9 shows a bottom view of a slide tray 10 upon which a modular toolbox 104 has been placed, showing how the male downwardly facing locking members 114 on the base of the modular toolbox are respectively received within cutouts 52, 58, 72, 78.

Figure 10:
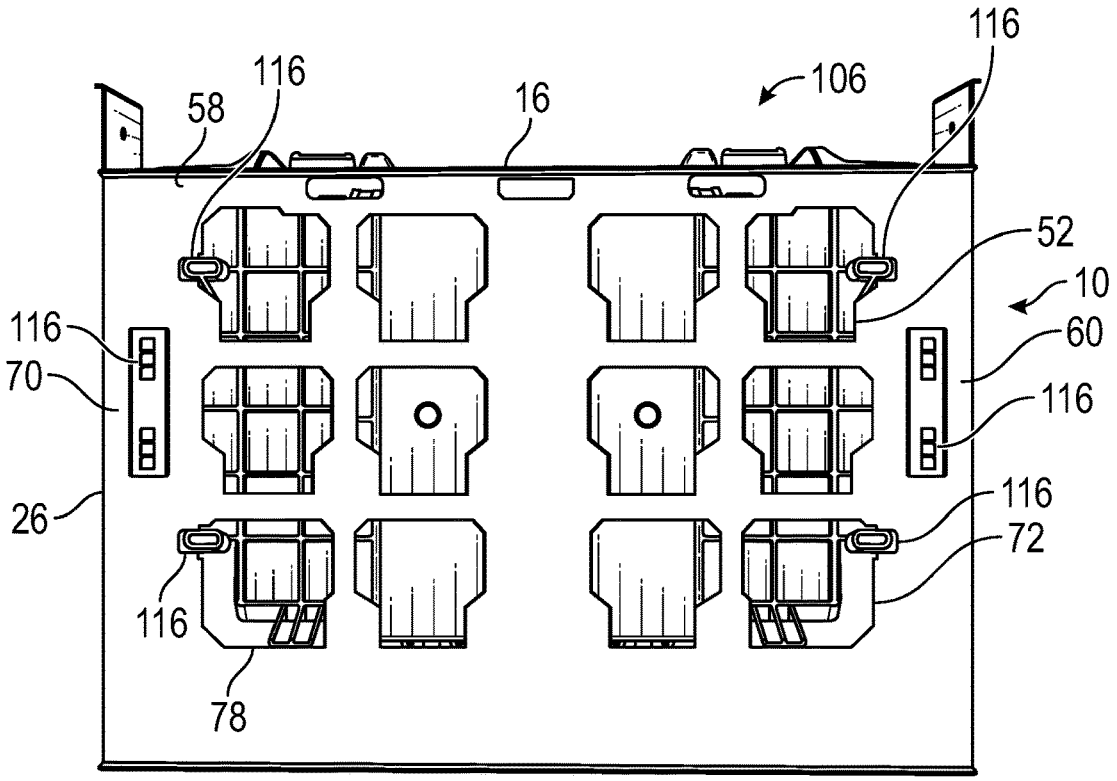
FIG. 10 shows a bottom view of the slide tray of FIGS. 7, 8 and 9 showing how it receive a modular toolbox having a different footprint from the modular toolbox shown in FIG. 9.

FIG. 10 shows a bottom view of a slide tray 10 upon which a modular toolbox 106 has been placed, showing how the male downwardly facing locking members 116 on the base of the modular toolbox are respectively received within cutouts 52, 58, 60, 70, 72, 78.

Figure 11:
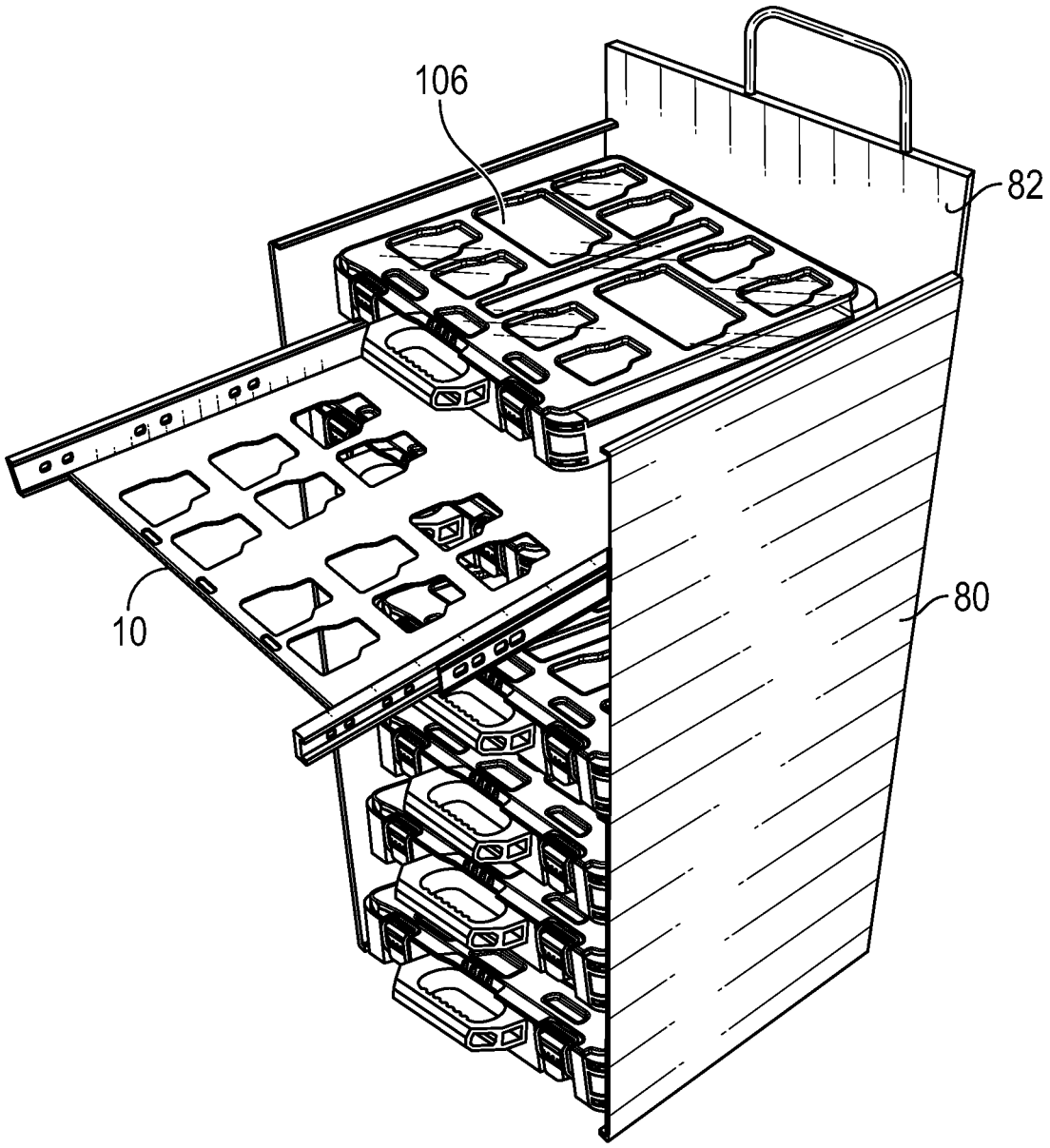
FIG. 11 shows an embodiment of the present invention in which the slide trays are contained within a cabinet enclosure with a withdrawn slide tray ready to receive a modular toolbox.
Figure 12:
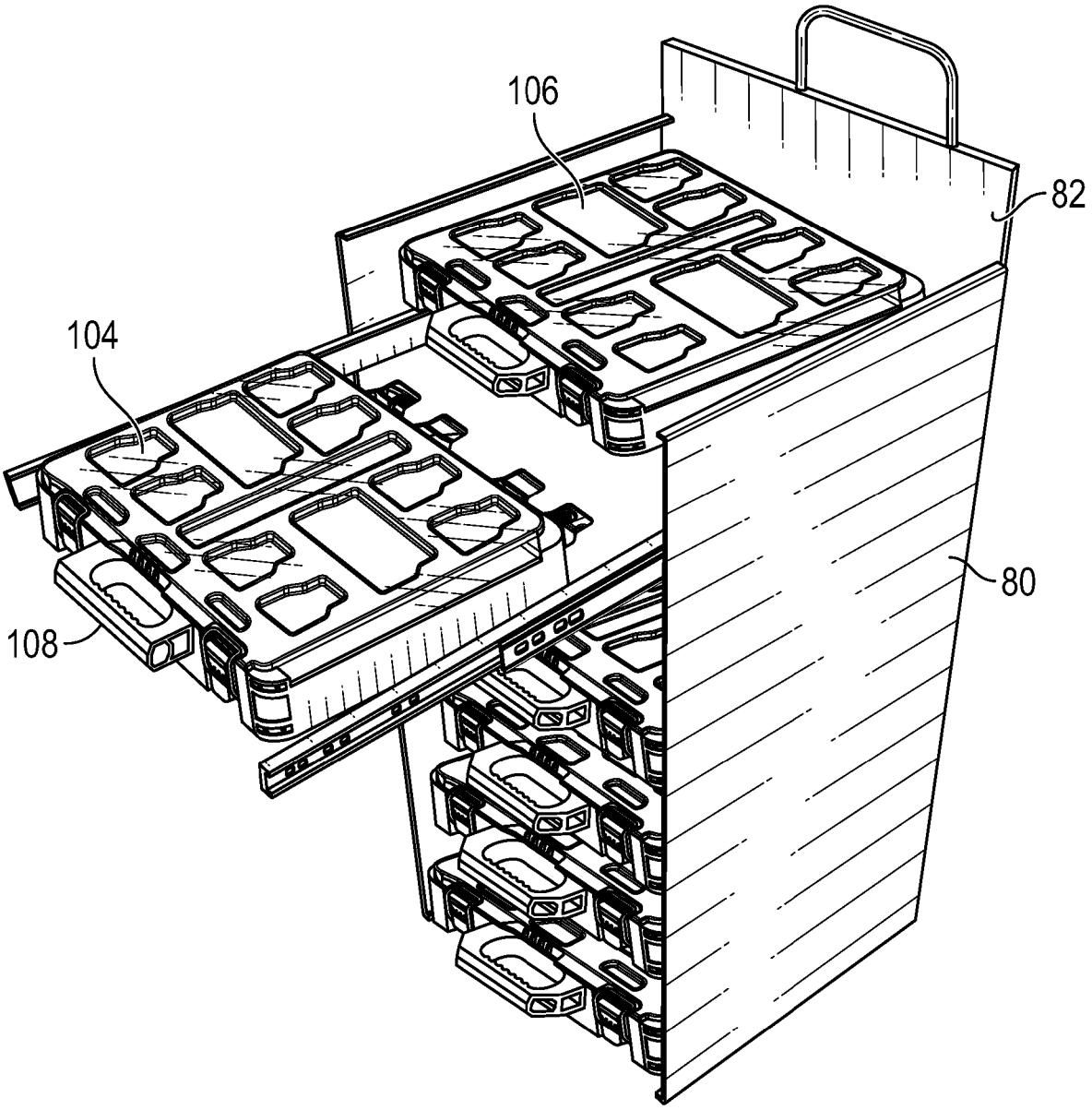
FIG. 12 shows an embodiment of the present invention in which a modular toolbox has been placed on a withdrawn slide tray.

FIG. 11 shows a plurality of slide trays 10 disposed within cabinet 80, wherein cabinet 80 has a back panel 82. Cabinet 80 may be mounted on wheels or casters (not shown) for ease of transport. Slide trays 10 may be used to store a plurality of modular toolboxes 100, 102, 104, 106, etc. have been placed. As indicated in FIG. 12, access to a particular modular toolbox 104 may be gained by simply pulling out on the handle 108 of the toolbox.

While the above is a description of various embodiments of the present invention, further modifications may be employed without departing from the spirit and scope of the present invention. Thus the scope of the invention should not be limited according to these factors, but according to the claims of the forthcoming non-provisional patent application.

The invention claimed is:

1. A slide tray configured to receive any one of several non-identical modular toolboxes, each modular toolbox having a base comprising a plurality of downwardly facing members, the slide tray comprising:

a left side, a right side, a front side and a backside and a rectangular bottom, wherein the rectangular bottom comprises consists of a matrix of non-square cutouts which penetrate through the rectangular bottom, the matrix of cutouts configured to engagingly receive the downwardly facing members of any of the several non-identical modular toolboxes, the matrix of cutouts comprising: (a) a first row of exactly three equivalent shaped and sized rectangular cutouts adjacent to the front side; (b) a second row of exactly four polygonal cutouts comprising, in order from the left side to the right side, a second row left outside cutout adjacent to the left side, a second row left inside cutout, a second row right inside cutout, and a second row right outside cutout adjacent to the right side, wherein the second row left outside cutout and the second row right outside cutout are mirror images of each other and have an equivalent size and shape, and the second row left inside cutout and the second row right inside cutout are equivalent in size and shape; (c) a third row of exactly six polygonal cutouts comprising, in order from the left side to the right side, a third row left rectangular cutout, a third row left outside cutout, a third row left inside cutout, a third row right inside cutout, a third row right outside cutout and a third row right rectangular cutout, wherein the third row left rectangular cutout and the third row right rectangular cutout are equivalent in size and shape, and the third row left outside cutout, the third row left inside cutout, the third row right inside cutout and the third row right outside cutout have an equivalent size and shape; and (d) a fourth row of exactly four polygonal cutouts comprising, in order from the left side to the right side, a fourth left outside cutout adjacent to the left side, a fourth row left inside cutout, a fourth row right inside cutout, and a fourth row outside cutout adjacent to the right side, wherein the fourth row left outside cutout and the fourth row right outside cutout are mirror images of each other and have an equivalent size and shape, and the fourth row left inside cutout and the fourth row right inside cutout are equivalent in size and shape.

2. A slide tray configured to receive any one of several non-identical modular toolboxes, each modular toolbox having a base comprising a plurality of downwardly facing members, the slide tray comprising:

a left side, a right side, a front side and a backside and a rectangular bottom, wherein the rectangular bottom comprises a matrix of non-square cutouts which penetrate through the rectangular bottom, the matrix of cutouts configured to engagingly receive the downwardly facing members of any of the non-identical modular toolboxes, the matrix of cutouts comprising: (a) a first row of exactly three equivalent shaped and sized rectangular cutouts adjacent to the front side; (b) a second row of exactly four polygonal cutouts comprising, in order from the left side to the right side, a second row left outside cutout adjacent to the left side, a second row left inside cutout, a second row right inside cutout, and a second row right outside cutout adjacent to the right side; (c) a third row of exactly six polygonal cutouts comprising, in order from the left side to the right side, a third row left rectangular cutout, a third row left outside cutout, a third row left inside cutout, a third row right inside cutout, a third row right outside cutout, and a third row right rectangular cutout; and (d) a fourth row of exactly four polygonal cutouts comprising, in order from the left side to the right side, a fourth left outside cutout adjacent to the left side, a fourth row left inside cutout, a fourth row right inside cutout, and a fourth row outside cutout adjacent to the right side.

3. The slide tray of claim 2 wherein the second row left outside cutout and the second row right outside cutout are mirror images of each other and have an equivalent size and shape.

4. The slide tray of claim 2 wherein the second row left inside cutout and the second row right inside cutout are equivalent in size and shape.

5. The slide tray of claim 2 wherein the third row left rectangular cutout and the third row right rectangular cutout are equivalent in size and shape.

6. The slide tray of claim 2 wherein the third row left outside cutout, the third row left inside cutout, the third row right inside cutout and the third row right outside cutout have an equivalent size and shape.

7. The slide tray of claim 2 wherein the fourth row left outside cutout and the fourth row right outside cutout are mirror images of each other and have an equivalent size and shape.

8. The slide tray of claim 2 wherein the fourth row left inside cutout and the fourth row right inside cutout are equivalent in size and shape.

* * * * *